US006408759B1

(12) United States Patent
Ewick et al.

(10) Patent No.: US 6,408,759 B1
(45) **Date of Patent: *Jun. 25, 2002**

(54) INITIATOR WITH LOOSELY PACKED IGNITION CHARGE AND METHOD OF ASSEMBLY

(75) Inventors: David W. Ewick, North Granby; Brendan M. Walsh, Simsbury, both of CT (US)

(73) Assignee: The Ensign-Bickford Company, Simsbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/402,868

(22) PCT Filed: Mar. 31, 1998

(86) PCT No.: PCT/US98/06146

§ 371 (c)(1),
(2), (4) Date: Feb. 29, 2000

(87) PCT Pub. No.: WO98/45663

PCT Pub. Date: Oct. 15, 1998

Related U.S. Application Data

(63) Continuation-in-part of application No. 08/831,664, filed on Apr. 9, 1997, now Pat. No. 5,889,228.

(51) Int. Cl.[7] ..... F42B 3/10; C06C 5/00

(52) U.S. Cl. ..... 102/202.5; 102/202.5; 102/275.5

(58) Field of Search ..... 102/202.5, 275.5, 102/202.7, 202.14, 202.3, 202.9

(56) References Cited

U.S. PATENT DOCUMENTS 3,021,786 A * 2/1962 Miller et al. ..... 102/275.5
3,106,892 A * 10/1963 Miller ..... 102/275.5
3,631,802 A 1/1972 Lawrence ..... 102/28 M (List continued on next page.)

OTHER PUBLICATIONS

Definition of "thermite", Hawley's Condensed Chemical Dictionary, Eleventh Edition, p. 1144, Date Unknown.

Definition of "compaction", McGraw–Hill Dictionary of Scientific and Technical Terms, Fifth Edition, p. 148, Date Unknown.

Fyfe et al; BNCP Prototype Detonator Studies Using A Semiconductor Bridge Initiator, Date Unknown.

Pacific Scientific E.D.D.; BNCP An Environmentally Friendly Replacement For the Primary Explosive Lead Azide, Nov. 1995.

*Primary Examiner*—Michael J. Carone
*Assistant Examiner*—Lulit Semunegus
(74) *Attorney, Agent, or Firm*—Libert & Associates; Frederick A. Spaeth

(57) ABSTRACT

An initiator (100) assembled from a housing (112), an output charge (144) and an initiation means (110, 120, 58, 54) includes a pulverulent ignition charge (46*a*) disposed in direct initiation relation to the initiation means, and an output charge (144) that may contain a pulverulent deflagration-to-detonation transition (DDT) charge (144*a*) and an explosive base charge (144*b*). The ignition charge (46*a*) has an average particle size of less than 10 microns, or even less than 5 microns, e.g., 1 to 2 microns. The initiation means may include a semiconductor bridge (18) and the ignition charge (46*a*) may be compacted with a force of less than about 5880 psi, e.g., with a force of 1000 psi. In another embodiment, an initiator (210) includes a low-energy electrical initiator (234), a loosely packed BNCP ignition charge (218) and a pyrotechnical output charge (214).

39 Claims, 5 Drawing Sheets

U.S. PATENT DOCUMENTS 3,763,783 A 10/1973 Thomas et al. ..... 102/28 M
3,981,240 A 9/1976 Gladden ..... 102/29
4,132,171 A * 1/1979 Pawlak ..... 102/275.5
4,329,924 A 5/1982 Lagofun ..... 102/202.8
4,331,078 A 5/1982 Habbel et al. ..... 102/202.11
4,484,960 A 11/1984 Rucker ..... 149/22
4,522,665 A 6/1985 Yates, Jr. et al. ..... 149/21
4,607,573 A 8/1986 Thureson et al. ..... 102/275.8
4,708,060 A 11/1987 Bickes, Jr. et al. ..... 102/202.7
4,712,477 A * 12/1987 Aikou et al. ..... 102/202.5
4,727,808 A * 3/1988 Wang et al.
4,730,558 A * 3/1988 Florin et al. ..... 102/202.7
4,730,588 A 3/1988 Florin et al. ..... 102/218
4,861,924 A 8/1989 Riggs ..... 568/931
4,869,170 A * 9/1989 Dahmberg et al. ..... 102/202.8
4,939,993 A 7/1990 Curutchet et al. ..... 102/202.14
4,976,200 A 12/1990 Benson et al. ..... 102/202.7
4,989,515 A * 2/1991 Kelly et al. ..... 102/202.9
4,994,125 A 2/1991 Mei ..... 149/22
5,031,538 A 7/1991 Dufrane et al. ..... 102/275.5
5,133,257 A * 7/1992 Jon sson
5,166,468 A 11/1992 Atkeson ..... 102/207
5,173,569 A * 12/1992 Pallanck et al.
5,309,841 A 5/1994 Hartman et al. ..... 102/202.4
5,385,098 A * 1/1995 Lindqvist et al. ..... 102/202.5
5,427,031 A 6/1995 Bowman ..... 102/331
5,431,101 A * 7/1995 Arrel, Jr. et al. ..... 102/202.5
5,503,077 A * 4/1996 Motley ..... 102/202.5
5,536,990 A 7/1996 Nelson ..... 310/339
5,889,228 A * 3/1999 Ewick et al. ..... 102/275.5

* cited by examiner

INITIATOR WITH LOOSELY PACKED IGNITION CHARGE AND METHOD OF ASSEMBLY

This application is a continuation-in-part of U.S. patent application Ser. No. 08/831,664, filed Apr. 9, 1997, now U.S. Pat. No. 5,889,228, issued Mar. 30, 1999, entitled "Detonator With Loosely Packed Ignition Charge and Method of Assembly".

BACKGROUND OF THE INVENTION

1. Field of the Invention

The present invention relates to initiators comprising ignition charges and to a method for assembling such initiators.

2. Related Art

U.S. Pat. No. 4,727,808, issued Mar. 1, 1988, to Wang et al, discloses an electrically-initiated detonator, an igniting means such as fuse head (9) or an electric resistance wire, low energy detonating cord, NONEL tube or safety fuse (see column 4, lines 41–44 and column 7, lines 21–28) and an initiating charge in initiation relation thereto. The initiating charge comprises a secondary explosive, such as PETN (pentaerythritol tetranitrate), RDX (cyclo-1,3,5-trimethylene-2,4,6-trinitramine), or a mixture thereof, with a particle size that may be below 30 micrometers ($\mu$m) and which may be pressed to a density in the range of 1.2 to 1.6 grams per cubic centimeter (g/cc) (see column 5, lines 11–32). The initiating charge is used to initiate the base charge of the detonator. An intermediate charge may be disposed between the initiating charge and the base charge and may have an even lower density, e.g., to 0.8 to 1.4 g/cc (see column 5, lines 33–45). Example 7 shows a test employing PETN at 5 to 15 $\mu$m particle size and a tamping of 133 kg (about 8660 psi) for a containment shell having an outer diameter of 6.5 millimeters (mm) and a wall thickness of 0.6 mm.

The "igniting means" mentioned in the Wang et al Patent draw or emit large amounts of energy relative to low energy initiation elements such as SCBs. Further, given the types of igniting means contemplated by Wang et al, the function time for the detonators disclosed therein will be on the order of about 50 microseconds. Because of this prolonged function time, the Wang et al detonators need to provide the confinement and empty chamber in the detonator to prevent the detonator shell from being destroyed by the gaseous products of the ignition charge before the detonation reaction is initiated in the base charge. In the embodiment of FIG. 13, the hollow interior of safety fuse 16 provides the empty chamber for this device.

Fyfe et al, in a paper entitled "BNCP Prototype Detonator Studies Using a Semiconductor Bridge Initiator", discloses the use of BNCP (tetraammine-cis-bis (5-nitro-2H-tetrazorato-$N^2$) cobalt (III) perchlorate) for use in electric detonators incorporating a semiconductor bridge (SCB) in welded 304 stainless steel confinements. One test device comprised 25 milligrams of BNCP pressed to 10,000 pounds per square inch (psi); another comprised 49 milligrams of BNCP pressed to 20,000 psi. Ignition sensitivity tests for two different particle sizes of BNCP, 15 and 25 microns, performed with a rise time of 15 microseconds, showed that the larger particles took about twice as long to ignite as the smaller particles at 3.5 amps and, at 1.5 amps, the smaller particles ignited but the larger particles did not. In addition, at a fifty-microsecond rise time, the smaller particles were less temperature-sensitive than the larger particles.

The SCB employed by Fyfe et al measured 90×270×2 $\mu$m, and consumed several millijoules of energy to ignite the BNCP. The reported 1 watt, 1 ampere no-fire of these detonators indicates that the BNCP charge was acting like a heat sink that quickly dissipated the ohmic heating of the SCB at the 1 watt, 1 amp no-fire current. Such heat absorption under no-fire conditions indicates that the BNCP was highly compacted.

A manufacturer of BNCP has published product literature suggesting the use of BNCP in place of lead azide as a primary explosive initiating charge and that BNCP is a DDT explosive with a theoretical maximum density of 2.03 g/cc.

U.S. Pat. No. 4,484,960 to Rucker, dated Nov. 27, 1984, discloses a bridgewire detonator comprising a boron/ferric oxide ignition composition. The ferric oxide particles are in the 0.2 to 1.2 $\mu$m range. In the example, the ignition composition is loosely loaded into a blasting cap shell in contact with the bridgewire.

U.S. Pat. No. 4,989,515 to Kelly et al, dated Feb. 5, 1991, discloses an iriter comprising a bridgewire in contact with an ignition charge comprising thermite, an incendiary composition. The ignition charge is in contact with a thermite output charge. The ignition charge is compacted to 50–70% of its theoretical maximum density (TMD) while the output charge is compacted to 90–99% TMD.

SUMMARY OF THE INVENTION

In one broad aspect, the present invention relates to an initiator such as a detonator or a pyrotechnical output initiator that comprises a specifically configured ignition charge. Thus, the invention provides an initiator comprising a housing, a low-energy electronic initiation means in the housing, and an ignition charge disposed in the housing in direct initiation relation to the initiation means and in a state of compaction of less than 7000 psi. The ignition charge serves to produce a deflagration signal in the housing in response to a low-energy initiation signal from the initiation means, and it comprises particles having an average particle size of less than 10 $\mu$m. There is also an output charge in the housing for producing an output signal in response to the deflagration signal of the ignition charge.

According to one aspect of the invention, the ignition charge may be disposed in a pulverulent form and may be subjected to a compaction force of less than 5880 psi. For example, the ignition charge is subjected to a compaction force of less than 3000 psi, or less than 2000 psi.

Preferably, the ignition charge comprises BNCP.

In accordance with another broad aspect of this invention, there is an initiator comprising an initiation means for producing an initiation signal that releases less than about 850 microjoules into the housing. Optionally, the initiation means may release less than about 425 microjoules into the housing, or less than about 250 microjoules, or even less than about 100 microjoules into the housing.

It is generally preferred that the ignition charge comprise BNCP particles having an average size of less than 10 $\mu$m, or less than 5 $\mu$m, e.g., having an average diameter in the range of from about 0.5 $\mu$m to 2 $\mu$m.

Typically, the initiation means comprises a semiconductor bridge (SCB) initiation element.

According to still another broad aspect of this invention, the initiator comprises an ignition charge disposed in a state of compaction of less than 65.9 percent of its theoretical maximum density (TMD). For example, the ignition charge may be disposed in a pulverulent form and is in a state of compaction in the range of from about 49 to 65 percent of its TMD, or in the range of from about 49 to about 59 percent of its TMD.

In more specific embodiments, the invention provides a low-energy initiation unit in the housing comprising an SCB and an ignition charge disposed in the housing in direct initiation relation to the SCB. The ignition charge may comprise BNCP having a particle size of less than 10 $\mu$m average diameter and in a state of compaction of less than 7000 psi.

Optionally, the ignition charge may comprise an adherent bead disposed on the SCB. The bead may comprise a mixture of BNCP and a binder.

In a particular embodiment, the initiator may comprise a containment shell secured to the initiation means in the housing, and the ignition charge may be disposed within the containment shell.

The invention also encompasses a method aspect, e.g., a method of assembling an initiator. One such method comprises pressing an output charge into a housing, disposing a pulverulent ignition charge into the housing in signal transfer relation to the output charge, securing an electronic initiation means in the housing in initiation relation with the ignition charge, and compacting the ignition charge with a force of less than about 5880 psi.

In another embodiment, the method may comprise pressing an electronic initiation means into an ignition charge with a force of less than about 5880 psi, securing the ignition charge to the initiation means, and then securing the ignition charge in the housing in signal transfer relation with the output charge, preferably without farther compacting the ignition charge.

In yet another embodiment, the method may comprise depositing a bead of ignition charge on an electronic initiation means, and securing the electronic initiation means in the housing with the ignition charge in initiation relation with the output charge in the housing.

DETAILED DESCRIPTION OF THE INVENTION AND PREFERRED EMBODIMENTS THEREOF

Figure 1A:
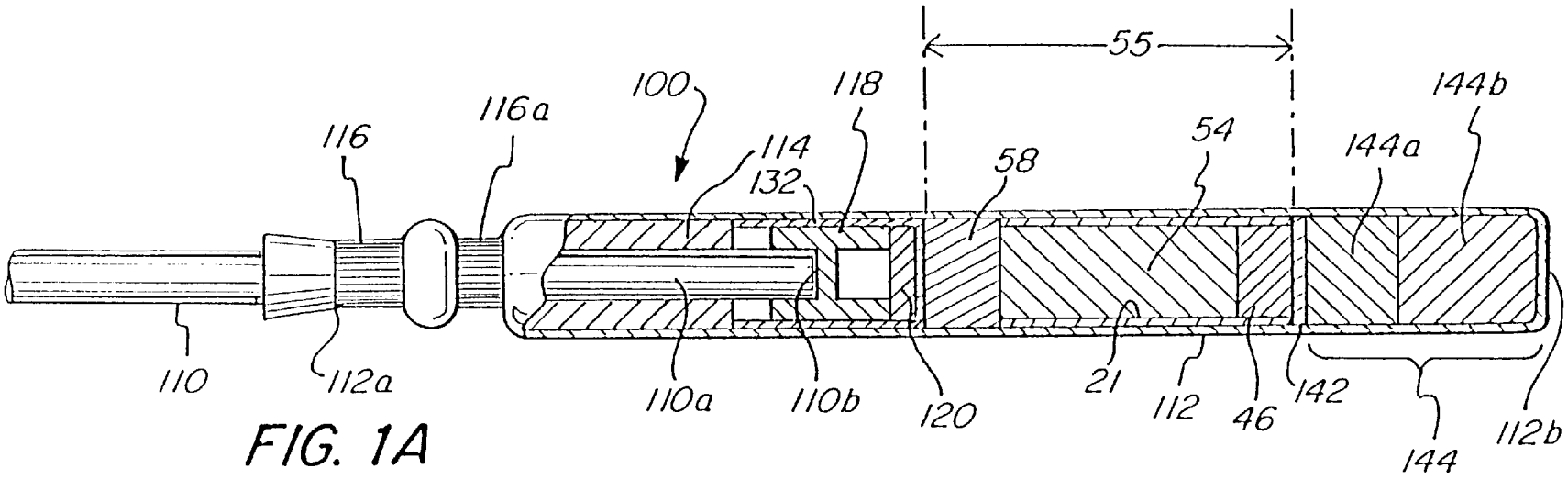
FIG. 1A is a schematic, partly cross-sectional view showing a detonator in accordance with one embodiment of the present invention.

The present invention relates to an improvement in the initiation of detonators and pyrotechnical initiators (sometimes referred to collectively herein as "brisant output devices" or "initiators"). A brisant output device in accordance with the present invention generally comprises a housing that contains an output charge, a low-energy initiation means and an ignition charge between the initiation means and the output charge. The ignition charge is configured so that it is sensitive to the low energy emitted by the initiation means, and has sufficient output energy to initiate the output charge. The output charge provides the principal output signal of the device.

The initiation means of the present invention provides a low-energy initiation signal for the interior of the detonator housing such as may be provided by a 1-ohm semiconductor bridge initiating element measuring 17×36×2 micrometers ("$\mu$m"), which can consume less than about 850 microjoules to produce an initiating plasma.

In a brisant output device according to the present invention, the ignition charge is disposed in the housing in a manner that allows it to be initiated by a lower energy signal from the initiation means than would have been effective for prior art initiators. For example, a 1-ohm SCB measuring 17×36×2 $\mu$m can initiate an ignition charge in accordance with the present invention with less than about 850 microJoules of energy.

The ignition charge is sensitive to the initiation means and, upon initiation, it provides a rapid burn deflagration in the housing sufficient to initiate the output charge. The ignition charge of the present invention generally has an average particle size of less than 10 microns, and is preferably loosely packed in the housing, e.g., at a compaction pressure of less than 7000 pounds per square inch ("psi"), as described below. The ignition charge is disposed in direct initiation relation to the initiation means, i.e., there is no intervening charge between the output of the initiation means and the ignition charge, and, preferably, no void space between them. Typically, the initiation means comprises a semiconductor bridge (SCB) that is in direct physical contact with the ignition charge. Preferably, the ignition charge comprises BNCP.

In the case of a brisant output device in accordance with this invention comprising a detonator, the output charge comprises an explosive material. Optionally, the output charge of a detonator may comprise a base charge and a distinct deflagration-to-detonation transition (DDT) charge for producing a detonation signal to initiate the base charge. In some such detonator embodiments, the base charge may comprise the same reactive material as the DDT charge but, in other embodiments, they may comprise different materials. For example, in one embodiment, the DDT charge may comprise BNCP and the base charge may comprise PETN (pentaerythritol tetranitrate), but in other embodiments, both the DDT charge and the base charge may comprise, e.g., BNCP. As is known in the art, a DDT charge is preferably rendered in the form of larger particles than an ignition charge. Accordingly, the DDT charge of the present invention preferably comprises particles having an average size of 25 $\mu$m or greater. In the alternative case of a pyrotechnical initiator according to this invention, the output charge typically comprises a pyrotechnical material to the substantial exclusion of explosive material that will generate a detonation output signal.

Referring now to FIG. 1A there is shown a digital delay detonator in accordance with one embodiment of the present invention. Delay detonator 100 comprises initiation means to provide a non-electric input signal to the interior of the detonator. The initiation means in the illustrated embodiment comprises a shock tube 110, a booster charge 120, a transducer module 58 and an electronics module 54. The transducer module converts the non-electric input signal to an electronic signal. For manufacturing purposes, the transducer module 58 has been secured to one end of the electronics module 54 and a transition cap 46 comprising the ignition charge has been secured to the other end to form an electronic delay initiation unit 55, which is described more fully below.

As is well-known to those skilled in the art, shock tube comprises hollow plastic tubing, the inside wall of which is coated with an explosive material so that upon ignition, a low-energy shock wave is propagated through the tube. See, for example, Thureson et al, U.S. Pat. No. 4,607,573, issued Aug. 26, 1986. It is to be understood, however, that other non-electric signal transmission means such as a detonating cord, low-energy detonating cord, low velocity shock tube and the like may be used. Generally, any suitable non-electric, impulse signal transmission means may be employed in the illustrated embodiment.

Shock tube 110 is fitted to a detonator shell or housing 112 by means of an adapter bushing 114 about which a generally tubular housing 112 is crimped at crimps 116, 116*a* to secure shock tube 110 and form an environmentally protective seal between adapter bushing 114 and the outer surface of shock tube 110. Housing 112 has an open end 112*a* which receives bushing 114 and shock tube 110, and an opposite, closed end 112*b*. Housing 112 is made of an electrically conductive material, usually aluminum, and is preferably the size and shape of conventional blasting caps, i.e., detonators. A typical aluminum housing has an inner diameter of 0.26 inch and an outer diameter of 0.296 inch. A segment 110*a* of shock tube 110 extends within housing 112 and terminates at end 110*b* in close proximity to, or in abutting contact with, an anti-static isolation cup 118.

Figure 1B:
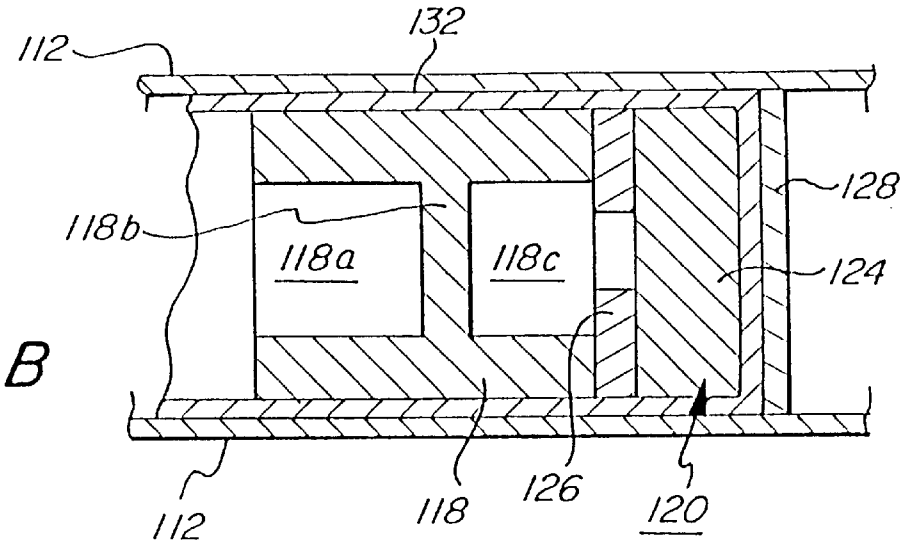
FIG. 1B is a view, enlarged relative to FIG. 1A, of the isolation cup and booster charge components of the detonator of FIG. 1A.

Isolation cup 118, as best seen in FIG. 1B, is of a type well-known in the art and is made of a semiconductive material, e.g., a carbon-filled polymeric material, so that it forms a path to ground to dissipate any static electricity which may travel along shock tube 110. For example, see U.S. Pat. No. 3,981,240 to Gladden, issued Sep. 21, 1976. A low-energy booster charge 120 is positioned adjacent to, and in force communicating relationship with, isolation cup 118. As best seen in FIG. 1B, isolation cup 118 comprises, as is well-known in the art, a generally cylindrical body (which is usually in the form of a truncated cone, with the larger diameter positioned closer to the open end 112*a* of housing 112) which is divided by a thin, rupturable membrane 118*b* into an entry chamber 118*a* and an exit chamber 118*c*. The end 110*b* of shock tube 110 (FIG. 1A) is received within entry chamber 118*a* (shock tube 110 is not shown in FIG. 1B for clarity of illustration). Exit chamber 118*c* provides an air space or stand-off between the end 110*b* of shock tube 110 and booster charge 120. In operation, the shock wave traveling through shock tube 110 will rupture membrane 118*b* and traverse the stand-off provided by exit chamber 118*c* and impinge upon and detonate booster charge 120.

Booster charge 120 comprises a small quantity of a primary explosive such as lead azide (or a suitable secondary explosive such as PETN or BNCP), upon which is disposed a first (non-explosive) cushion element 126. First cushion element 126, which is located between isolation cup 118 and the primary explosive, protects the primary explosive from pressure imposed upon it during manufacture.

A non-conductive buffer 128 (not shown in FIG. 1A), which is typically 0.030 inch thick, is located between booster charge 120 and a transducer module 58 (described more fully below) to electrically isolate transducer module 58 from booster charge 120.

Isolation cup 118, first cushion element 126, and booster charge 120 may conveniently be fitted into an electrically conductive booster shell 132 as shown in FIG. 1B. The outer surface of isolation cup 118 is in conductive contact with the inner surface of booster shell 132 which in turn is in conductive contact with housing 112 to provide an electrical current path for any static electricity discharged from shock tube 110. Generally, booster shell 132 is inserted into housing 112 and housing 112 is crimped to retain booster shell 132 therein as well as to protect the contents of housing 112 from the environment.

As indicated above, the transducer module 58 is coupled with an electronics module 54 which in turn is connected to a transition cap 46 to form an electronic delay initiation unit 55. An optional open-ended steel sleeve 21 encircles electronics module 54 and transition cap 46 to protect them against lateral deformation of housing 112. Transition cap 46 comprises an ignition charge in accordance with the present invention, as will be described more fully below in relation to FIG. 2. Adjacent to transition cap 46 is an optional second cushion element 142, which is similar to first cushion element 126. Second cushion element 142 separates transition cap 46 from output charge 144, which comprises a DDT charge 144*a* that is sensitive to the ignition charge of electronics module 54 and that is capable of converting the pyrotechnical signal of the ignition charge in transition cap 46 to a detonation shock wave signal. Output charge 144 preferably comprises a base charge 144*b* of secondary explosive, e.g., PETN, RDX (cyclo-1,3,5-trimethylene-2,4,6-trinitramine) or the like, which provides the principal explosive output of the detonator, which may be used to initiate a cast booster explosive, dynamite, etc.

Figure 2:
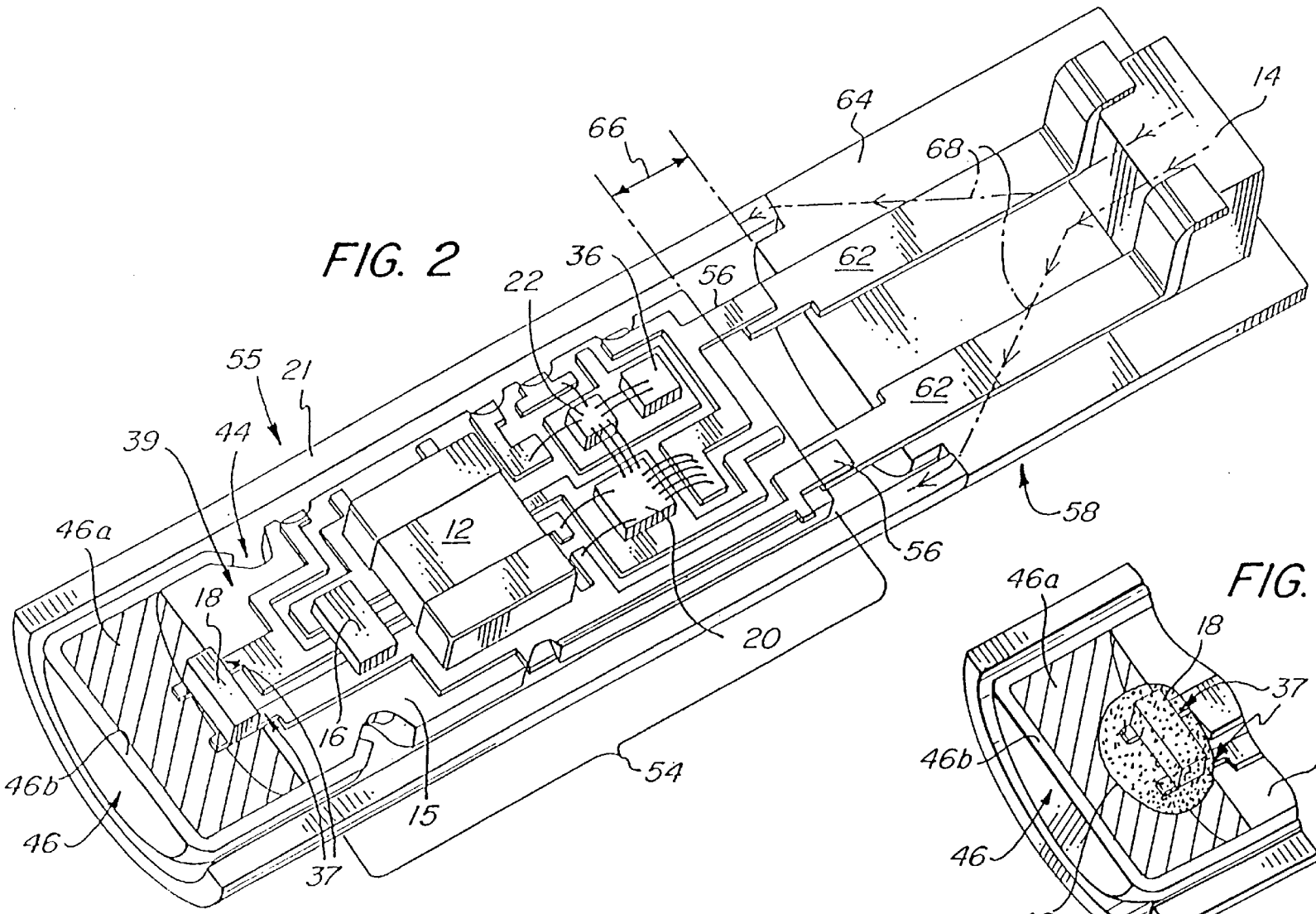
FIG. 2 is a partly cross-sectional perspective view of an initiation unit comprising an ignition charge in accordance with one embodiment of the invention.

FIG. 2 provides a partly cross-sectional perspective view of a low-energy electronic initiation unit 55. Electronics module 54 of initiation unit 55 includes various circuit components including an integrated timing circuit 22, a timing resistor 36, an integrated switching circuit 20, a storage capacitor 12, a bleed resistor 16 and output leads 37 that provide an output terminal. The various components are disposed within a protective encapsulation 15. There is also a semiconductor bridge (SCB) 18 measuring 17×36×2 $\mu$m, disposed across output leads 37, which provides the initiation signal to the interior of the detonator housing. Transition cap 46 comprises a containment shell 46*b* that is crimped onto neck region 44 of encapsulation 15. Containment shell 46*b* contains and holds an ignition charge 46*a* in direct initiation relation to SCB 18. In other words, there is no intervening charge of reactive material or empty space between ignition charge 46*a* and SCB 18. To dispose SCB 18 in direct initiation relation with ignition charge 46*a* in the illustrated detonator, SCB 18 may be embedded in ignition charge 46*a*, as shown. The ignition charge 46*a* may comprise, e.g., about 10 to 20 milligrams of a primary explosive material or a suitable substitute therefor such as BNCP. Preferably, ignition charge 46*a* consists essentially of BNCP, to the exclusion of materials that would prevent the initiation of BNCP under the conditions described herein, i.e., at low compaction, mild confinement and low energy initiation.

As indicated above, ignition charge 46*a* comprises small particles, e.g., with an average particle size of smaller than 10 $\mu$m . In addition, the charge is preferably in a state of low compaction or low density. In the illustrated embodiment, before securing transition cap 46 to encapsulation 15, pulverulent ignition charge 46*a* is loosely disposed in shell 46*b*, which is dimensioned and configured to receive the end of encapsulation 15. For example, ignition charge 46*a* may be poured into shell 46*b* in powder form and remain there without being subjected to tamping or "pressing" or "compacting", except to the extent that the SCB 18 and the end of the electronics module cause compaction when the SCB is inserted into the ignition charge 46*a*, which can be reduced accordingly. This contrasts with prior art practice which taught compaction at, e.g., 10,000 psi. Optionally, mild compaction may be performed at less than 7000 psi, e.g., less than 4000 psi, less than 3000 psi or less than 2000 psi, e.g., 1000 psi. The output end 39 of electronics module 54 and encapsulation 15 is pressed into the ignition charge 46*a*. One advantage of the use of such low compaction pressures is that the chance of damaging the SCB 18 and the electronics module 54 as a whole is reduced because it becomes unnecessary to subject the electronics module 54 to high assembly forces. As a result, the ignition charge 46*a* is lightly compressed within containment shell 46*b*. Containment shell 46*b* is then crimped down onto neck region 44 to secure transition cap 46 onto encapsulation 15. The crimp and the structural strength of shell 46*b* are sufficient to prevent subsequent assembly steps that involve moderate axial force from imposing additional pressure between ignition charge 46*a* and electronics module 54. Thus, the low compaction state of the ignition charge is preserved even if subsequent assembly steps involve the use of some pressure. Containment shell 46*b* is made from 0.005 inch thick aluminum or a material of similar strength, and so does not provide the degree of containment evidently used by Fyfe et al in the disclosure discussed above, but it can withstand low axially-applied assembly forces. Sleeve 21 is helpful in sustaining axial assembly forces and thus shielding transition cap 46 from further compaction. Since sleeve 21 is open-ended, however, it does not contribute significantly to the containment of ignition charge 46*a*, so even with shell 46*b*, sleeve 21 and housing 112, ignition charge 46*a* is not highly confined.

The Applicants have found that the sensitivity of BNCP particles is not only size dependent but is also affected by compaction pressure. This conclusion was drawn from the results of testing in which 10 μm BNCP and 2 μm BNCP ignition powders were compacted to various pressures for attempted initiation by 1-ohm SCBs. The SCBs measured 17×36×2 μm on silicon substrate "chips" and were fired using energy from a 0.47 microfarad capacitor discharge unit. The SCB chips were mounted using a dielectric epoxy adhesive onto platforms comprised of Kovar, a registered trademark of CRS Holdings, Inc., having conductive leads extending therethrough, known in the art as a header unit. The BNCP was pressed with varying force into steel charge holders to which the header units were attached. The SCBs were fired at various voltages, with the results indicated in TABLE I.

TABLE I

| Average BNCP Particle Size (μm) | Compaction Pressure (Kpsi) | Firing Voltage (volts) | Fire(Yes)/Fail(No) |
|---|---|---|---|
| 10 | 10 | 100 | Yes |
| 10 | 10 | 60 | Yes |
| 10 | 10 | 40 | Yes |
| 10 | 7 | 100 | Yes |
| 10 | 7 | 60 | Yes |
| 10 | 7 | 40 | No |

TABLE I-continued

| Average BNCP Particle Size (μm) | Compaction Pressure (Kpsi) | Firing Voltage (volts) | Fire(Yes)/Fail(No) |
|---|---|---|---|
| 10 | 4 | 100 | No |
| 2 | 1 | 60 | Yes |
| 2 | 1 | 40 | Yes |
| 2 | 1 | 40 | Yes |
| 2 | 1 | 30 | Yes |
| 2 | 1 | 25 | Yes |

The data of TABLE I show that as BNCP compaction pressure decreases, 10 μm BNCP becomes increasingly insensitive to low-energy initiation. At 7000 psi, a charge of 60 volts (corresponding to a stored energy level of about 850 microJoules, about half of which is estimated to have been consumed by the firing circuitry) was required to initiate the BNCP; 40 volts was inadequate. At 4000 psi, even 100 volts did not initiate the 10 μm BNCP. However, the Applicants found that BNCP with average particle sizes of less than 10 μm, e.g., about 2 μm, sensitivity is increased to a degree that initiation could be achieved with less than 60 volts.

Similar tests were conducted by mixing 2 μm BNCP with nitrocellulose and rendering the mixture as a slurry, as described below. Beads of the slurry were applied to SCBs as described above and were allowed to dry. The SCBs were fired using various voltage levels and ignition of the BNCP was achieved in the range of 100 to 30.5 volts; ignition did not occur at 30 volts. Further testing using 1 μm BNCP showed that initiation was attained down to 25 volts. Function times were all about 10 microseconds or less.

An unexpected result of preparing an initiator with an ignition charge in accordance with the present invention is that initiation occurs so rapidly that the need to confine the reactive materials in the detonator is reduced. For example, Fyfe et al found it necessary to provide a significant degree of confinement to assure proper initiation of a BNCP charge in a detonator, but they were examining highly compacted BNCP in a 15 to 25 micron size range. On the other hand, U.S. Pat. No. 4,727,808 to Wang et al, described above, teaches the need for a void space in the detonator. The void space allows for the dissipation of pressure from the ignition charge. Such dissipation is necessary because the ignition charge burns so slowly that the pressure build-up may damage the detonator before the explosive charge is initiated. In contrast, the ignition charge of the present invention achieves such a high rate of reaction that the ignition signal is transferred to the output charge before any deleterious damage to the initiator can occur. Accordingly, the need for either a high degree of confinement or a void space in the housing has been obviated. The present invention may optionally be expressed as providing one or both of mild confinement and direct contact between the ignition charge and the initiation means, rather than strong confinement and void spaces for expansion of ignition charge product gases, respectively. The use of structures that provide strong confinement can be employed, however, if desired.

Further, the ignition charge can be reliably initiated with less energy than was required in the prior art. For example, a loosely packed, small-particle ignition charge disposed in direct initiation communication with a semiconductor bridge can be initiated by the semiconductor bridge with less than about 0.25 millijoule of energy. The electronic initiation unit of a detonator for use with the present invention may be configured to provide less than 0.1 millijoule (100 microjoules) of energy. In a particular embodiment, satisfactory initiation was attained with an initiation unit configured to provide about 0.068 millijoule. In contrast, prior art detonators require that the SCB initiation element be provided with at least 0.25 millijoule or greater. See, e.g., U.S. Pat. No. 5,309,841 to Hartman et al at column 7, lines 10–15 (0.25 milliJoule); U.S. Pat. No. 4,708,060 to Bickes, Jr. et al Example 1 and column 6, lines 7–11 (suggesting the use of a semiconductor bridge measuring 17×35×2 microns and fired with 1 to 5 milliJoules).

Preferably, the particle size of the pulverulent ignition charge is such that the diameter of the average particle is not greater than the length of the semiconductor bridge of delay circuit 134. In a particular embodiment comprising a semiconductor bridge measuring 17 microns (μm) in length (measured in the output lead-to-output lead direction)×36 μm in width×2 μm in depth, the average particle diameter is less than 10 μm , preferably less than 5 μm and may be, for example, in the range of 0.5 to 2 μm.

As suggested above, the encapsulated delay circuit may be pressed into ignition charge 46*a* with little pressure relative to prior art detonators. The tamping pressure on the ignition charge may be less than about 4,000 psi, for example, or even less than 2,000 psi. In a particular assembly process, electronics module 54 may be pressed into ignition charge 46*a* with a force of about 1,000 psi. The resulting density of the ignition charge 46*a* will be significantly less than that of conventional ignition charges. In typical embodiments of this invention, ignition charge 46*a* is pressed to less than 80 percent of its theoretical maximum density ("TMD"), for example, ignition charge 46*a* may be pressed to less than 65.9 percent of its TMD. For example, an ignition charge 46*a* comprising BNCP may have a density in the range of from 1 to 1.32 grams per cubic centimeter (g/cc) (about 49 to 65 percent TMD) for example, the ignition charge 46*a* may have a density in the range of from about 1 to 1.2 g/cc (about 49 to about 59 percent TMD). With the ignition charge in such a low state of compaction, the structural elements of a detonator in accordance with the present invention, i.e., housing 112, transition cap 46, and sleeve 21, are not relied upon to provide confinement of the DDT charge, and can be made from thinner, less rigid material than would be required if pressures of 10,000 psi or 20,000 psi had to be withstood, as taught by Fyfe. Such structural elements would then provide mild confinement of the ignition charge instead of strong confinement as taught by Fyfe et at. The low tamping pressure between the encapsulation, the electronic delay circuit and the ignition charge is advantageous because it reduces the chance that the assembly process will cause damage to SCB 18 and/or to the electronic delay circuit.

Figure 2A:
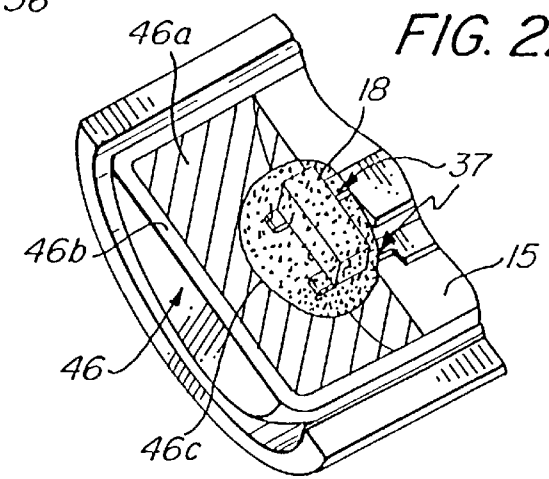
FIG. 2A is a partial view similar to FIG. 2 of an initiation unit according to another embodiment of the invention.

In alternative embodiments, a bead comprising the pulverulent ignition charge may be applied or adhered directly onto SCB 18 as shown in FIG. 2A, to assure good physical contact of ignition charge particles with the SCB. Bead 46*c*, which is typically applied as a slurry of particles that is allowed to dry on the SCB and thus adhere thereto, typically provides about 5 milligrams (mg) or less of solid reactive material on the SCB, and the coated SCB may be pressed into the powdered remainder of the ignition charge in transition cap 46. Such a slurry comprises the particulate ignition charge in a fluid medium such as water, volatile organic liquid, or the like and, optionally, a binder. Preferably, the binder comprises reactive material such as nitrocellulose. Optionally, the bead may entirely comprise the ignition charge of the detonator, and the coated SCB may be pressed into the output charge, e.g., into the DDT charge portion of an output charge. The bead-coated SCB may be pressed into a charge comprising additional ignition charge material or DDT-grade material, with a force of less than 7000 psi, as described above. Alternatively, cap 46 may be open ended and may be filled with the slurry after it is secured onto encapsulation 15. The slurry is then dried before the electronics module is inserted into the detonator housing.

In all embodiments in which BNCP is deposited as a bead on the SCB (e.g., see adherent bead 46*c*, FIG. 2A), the material in the dried bead experiences only the compaction pressure with which the bead is pressed into a subsequent charge or other component in the detonator housing.

As indicated by FIG. 2, electronics module 54 may be dimensioned and configured to have electrical output leads 37 that protrude into the ignition charge 46*a* so that SCB 18 can be surrounded by, or embedded in, the ignition charge 46*a*. Such an arrangement improves the reliability with which SCB 18 initiates ignition charge 46*a* by allowing a high degree of surface area contact between them, as opposed to having an SCB mounted flat on a support substrate.

Electronics module 54 is designed so that output leads 37 and electrical input leads 56 protrude from respective opposite ends of electronics module 54. The transducer module 58, which comprises a piezoelectric transducer 14 and two transfer leads 62, is enclosed within a transducer encapsulation 64 that is dimensioned and configured to engage sleeve 21 so that transducer module 58 can be secured onto the end of sleeve 21 with transfer leads 62 in contact with input leads 56. Preferably, electronics module 54, sleeve 21 and transducer module 58 are dimensioned and configured so that when assembled, as shown in FIG. 2, an air gap indicated at 66 is established between electronics module 54 and transducer module 58. In this way, electronics module 54 is at least partially shielded from the initial pressure pulse that causes piezoelectric transducer 14 to create the electrical pulse that activates electronics module 54. The pressure imposed by such initial pulse is transferred through transducer module 58 onto sleeve 21, as indicated by force arrows 68, rather than onto electronics module 54.

Ignition charge 46*a* is disposed in the detonator housing in signal transfer relation to the DDT charge portion 144*a* of output charge 144. As indicated above, the function of DDT charge 144*a* is to convert the pyrotechnical signal of ignition charge 46*a* into a detonation signal sufficient to initiate a detonation output of the base charge 144*b* of output charge 144. Output charge 144 provides the explosive output for the detonator and generally comprises a secondary explosive material. In accordance with the present invention, DDT charge 144*a* is a pulverulent charge comprising larger particles than conventionally used in the prior art that may comprise, e.g., about 75 to 150 milligrams of material. The coarse DDT particles are generally at least about 25 microns in diameter, preferably at least 50 microns in diameter and, in a particular embodiment, they have an average diameter in the range of about 100 to 120 microns. In a preferred embodiment of the invention, DDT charge 144*a* comprises BNCP that may be pressed in the detonator housing with a tamping pressure of, e.g., about 10,000 psi. Such a DDT charge will typically have a depth of about ¼ inch in a detonator housing having an inner diameter of 0.26 inch and an outer diameter of 0.296 inch.

Base charge 144*b* comprises a secondary explosive material, e.g., PETN, that is initiated by the DDT charge 144*a* and which provides the output signal for the detonator.

Optionally, base charge 144*b* may comprise the same explosive material as DDT charge 144*a*, e.g., both charges may comprise BNCP. However, BNCP is relatively expensive, so it is preferred to limit the BNCP to the ignition charge and the DDT charge, and to use PETN, which is less expensive than BNCP, for the base charge of the detonator. The use of BNCP in conjunction with the secondary base charge is advantageous relative to the use of lead azide because BNCP lacks lead and is therefore more acceptable from an environmental and health hazard standpoint. Further, BNCP has a stronger output force than lead azide, and so contributes to the explosive output of the detonator to a greater degree than lead azide. As a result, the quantity of secondary explosive of base charge 144*b* can be reduced proportionately. The secondary explosive of base charge 144*b* is provided in an amount suitable to yield (in combination with the output of the ignition charge) an output signal of the desired strength. A typical quantity of base charge material is about 500 to 1000 milligrams.

A detonator such as detonator 100 can be assembled by inserting various elements into a typically metallic detonator housing having one closed end and one open end. The elements are inserted into the housing sequentially with the first element being disposed against the closed end of the housing. In an assembly procedure suitable for detonator 100, output charge 144 may be pressed into the bottom, i.e., into the closed end of housing 112 under normal tamping pressure, e.g., a base charge 144*b* of PETN may be pressed to 10,000 psi in housing 112. A second cushion element 142 is disposed adjacent to output charge 144. Initiation unit 55 is then inserted into housing 112 adjacent to second cushion element 142. This disposes transition cap 46 in initiation relation to output charge 144 and disposes transducer module 58 towards the open end of the detonator housing. Booster charge 120 is thus situated in signal transfer relation with transducer module 58. The end of shock tube 110, which is encased by adapter bushing 114, is inserted into the open end of detonator housing 112 so that the end 110*b* of shock tube 110 engages isolation cup 118 within booster shell 132. At that point, detonator housing 112 is crimped at crimps 116, 116*a* to secure the shock tube 110 and the initiation unit in the detonator housing. The ignition charge of initiation unit 55 is prepared as described above, so that in the finished detonator, the ignition charge remains loosely packed.

In operation, a signal emitted by shock tube 110 (FIG. 1A) initiates booster charge 120, which produces a pressure pulse that activates piezoelectric transducer 14 (FIG. 2). The pulse of electrical energy produced by piezoelectric transducer 14 is received and stored by the electronics module 54 for a predetermined delay period. The electrical energy is then released to SCB 18 to provide the output signal of the initiation means of detonator 100. The ignition charge 46*a*, being in direct initiation elation to the initiation means, i.e., to SCB 18, is initiated thereby, and it initiates the DT charge 144*a*, which provides a detonation shock wave to initiate base charge 144*b* (FIG. 1A).

An initiator in accordance with the present invention that generates a pyrotechnical output signal, i.e., that yields an output comprising heat, flame and hot gases instead of a detonation signal, has a variety of uses, including, for example, the initiation of the gas-generating charges of an automotive safety air bag. Such an initiator may comprise an SCB that fires in response to an electrical impulse generated by a sensor in the bumper of the automobile upon impact. The signal generated by the sensor may be a low-energy signal as described above and the SCB may be configured similarly to the SCB of initiation unit 55 (FIG. 2). In the case of an air bag initiator, time delay circuitry is generally not needed. Instead, the SCB may be mounted on a header and may be directly connected to electrical leads for the initiation input signal.

Figure 3:
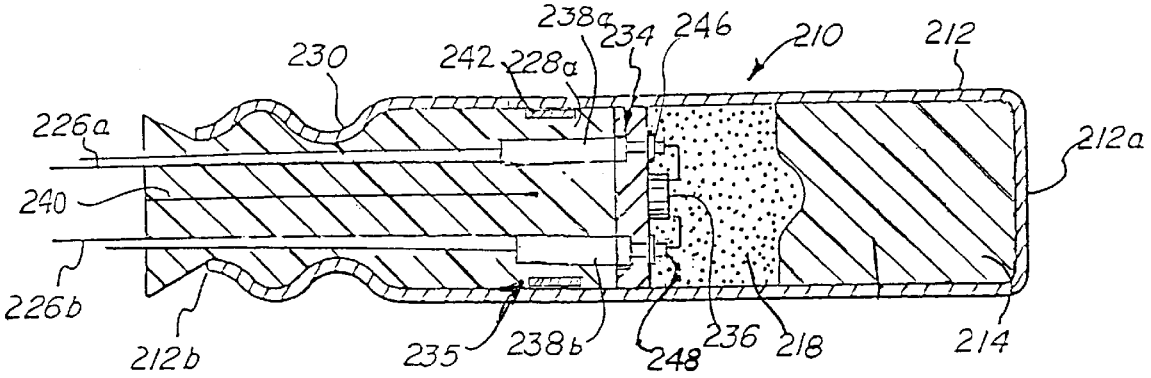
FIG. 3 is a schematic cross-sectional view of a pyrotechnical output initiator in accordance with a particular embodiment of the present invention.
Figure 4:
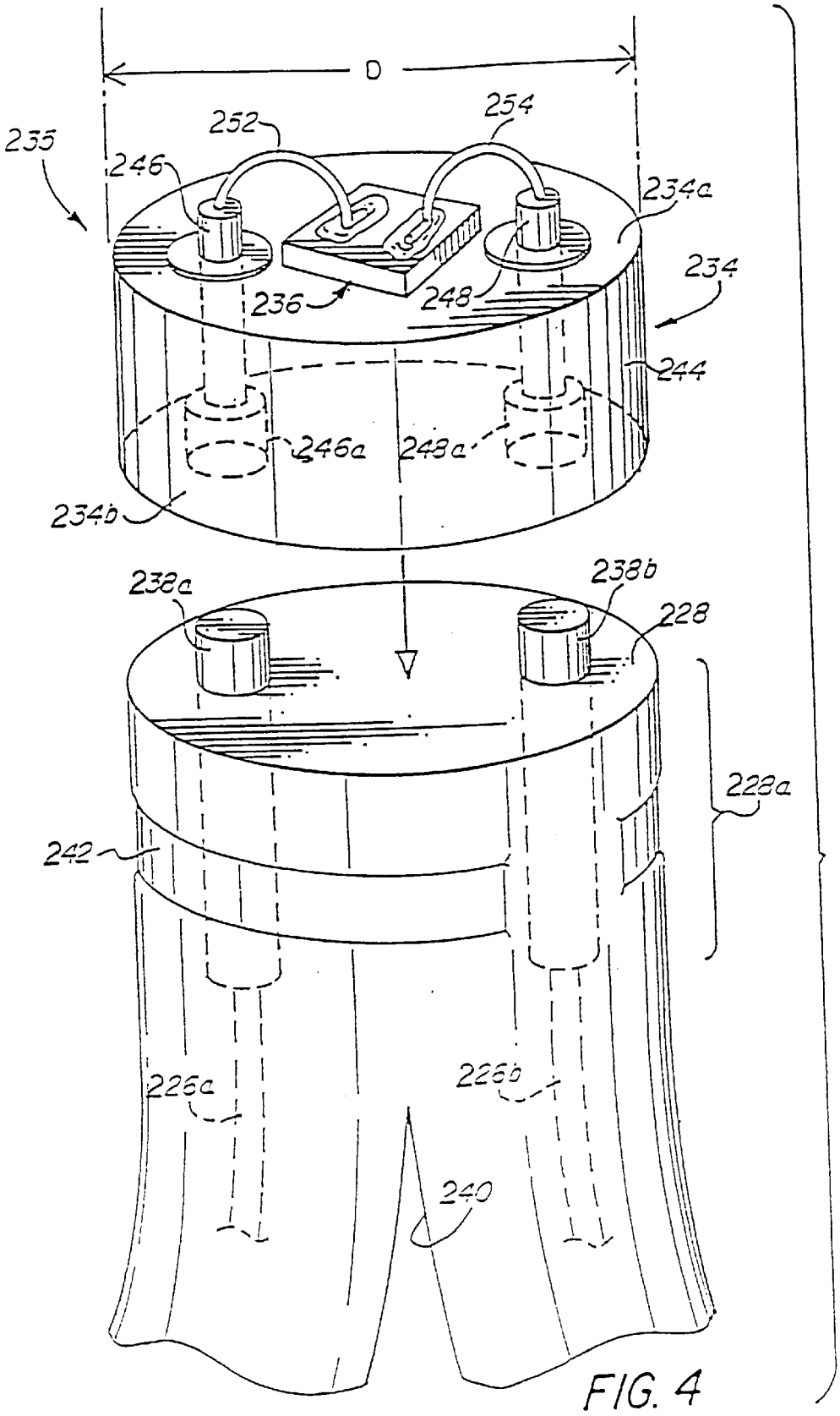
FIG. 4 is an enlarged perspective view of the semiconductor bridge (SCB) initiator assembly of the detonator of FIG. 3.

One pyrotechnical output initiator in accordance with the present invention is shown schematically in FIG. 3. Initiator 210 comprises a housing 212 that has a generally cylindrical configuration with a closed end 212*a* and an open end 212*b* and contains a pyrotechnical output charge 214 and an ignition charge 218. The ignition charge 218 preferably comprises a loosely packed charge of BNCP as described above, e.g., for ignition charge 46*a* (FIG. 2). The output charge 214 comprises a pyrotechnical material such as zirconium potassium perchlorate, titanium potassium perchlorate, etc. Input leads 226*a* and 226*b* extend into the interior of housing 212 and are secured therein by a closure bushing 228 and crimp 230. Input leads 226*a* and 226*b* carry an electrical initiation signal to an initiator module 234. Initiator module 234, better shown in FIG. 4, comprises a semiconductor bridge initiator element 236. When the electrical initiation signal is transferred via input leads 226*a* and 226*b* to initiator module 234, the SCB initiator element 236 initiates the ignition charge 218 (FIG. 3), thus initiating the output charge of the detonator. Together, bushing 228 (with leads 226*a*, 226*b* therein) and initiator module 234 comprise an initiator assembly 235.

Bushing 228 (FIG. 4) has a head portion 228*a* within which connector studs 238*a* and 238*b* are disposed. Bushing 228 is preferably formed from an elastic synthetic polymeric material. The head portion 228*a* of bushing 228 is generally cylindrical and it has a diameter that corresponds approximately to the interior diameter of the detonator housing (not shown), e.g., about 0.233 inch (5.9 mm). The remainder of bushing 228 is split at seam 240 to facilitate the insertion of the exposed ends of electrical leads 226*a* and 226*b* into the open ends of connector studs 238*a* and 238*b*. Clamp ring 242 applies a clamping pressure on the head portion 228*a* of bushing 228 to help secure leads 226*a* and 226*b* in connector studs 238*a* and 238*b*, respectively.

Initiator module 234 comprises a generally cylindrical non-conductive pill 244 that may be formed from a polymeric material, e.g., an epoxy resin. Connector terminals 246 and 248 extend through pill 244 to top surface 234*a* and bottom surface 234*b*. Near bottom surface 234*b*, connector terminals 246 and 248 form coupling recesses 246*a*, 248*a*, which are dimensioned and configured to engage connector studs 238*a* and 238*b* on bushing 228. The SCB initiator element 236 is adhered to the top surface 234*a* of pill 244, preferably between connector terminals 246 and 248, in any convenient manner, e.g., by epoxy adhesive. Two 5 mil (0.005 inch) aluminum bond wires 252, 254 extend between the exposed ends of connector terminals 246 and 248 and associated conductor pads (not shown) on SCB initiator element 236, and may be sonically welded in place at each end by a process well-known in the art.

Like bushing 228, pill 244 is generally cylindrical and has a diameter D that corresponds to the internal diameter of the detonator housing (not shown). Preferably, connector studs 238*a*, 238*b* and coupling recesses 246*a*, 248*a* are configured so that once studs 238*a* and 238*b* are inserted into recesses 246*a*, 248*a*, they will be securely retained therein, e.g., by a locking mechanism such as a leaf spring detent on studs 238*a*, 238*b* and corresponding grooves in coupling recesses 246*a*, 248*a*. Thus, initiator module 234 and bushing 228 (including leads 226*a*, 226*b*) will be joined together to constitute initiator assembly 235 and to provide electrical continuity between leads 226*a*, 226*b* and bond wires 252, 254. Initiator assembly 235 allows an initiation signal to be conveyed from an external device to the interior of the detonator and, in particular, to the ignition charge.

Figure 5A:
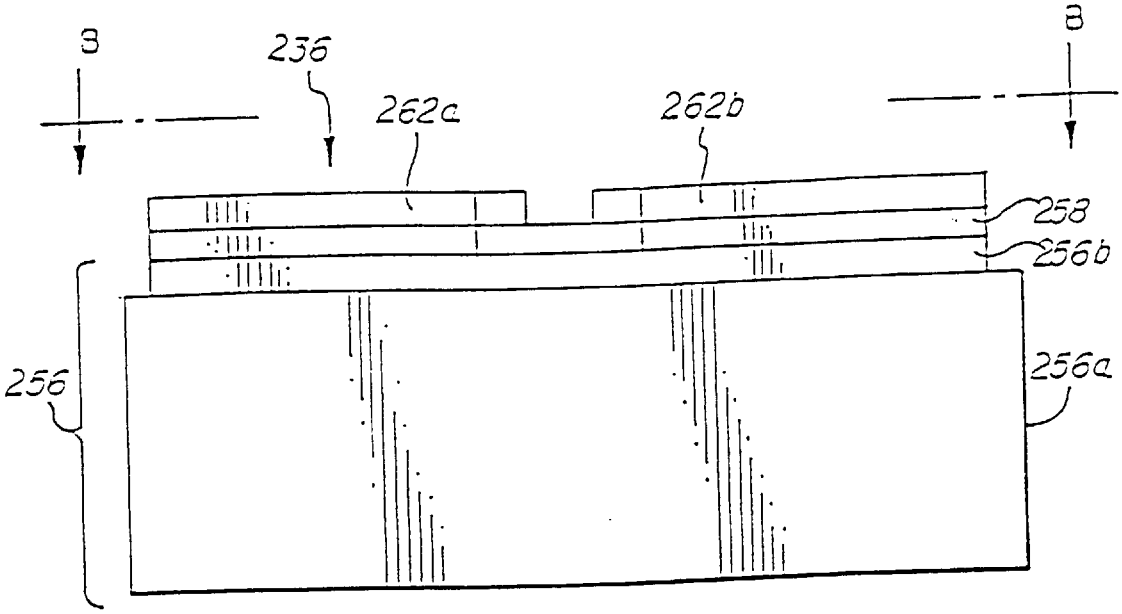
FIG. 5A is an enlarged elevational view of the SCB initiator element in the initiator assembly of FIG. 4.
Figure 5B:
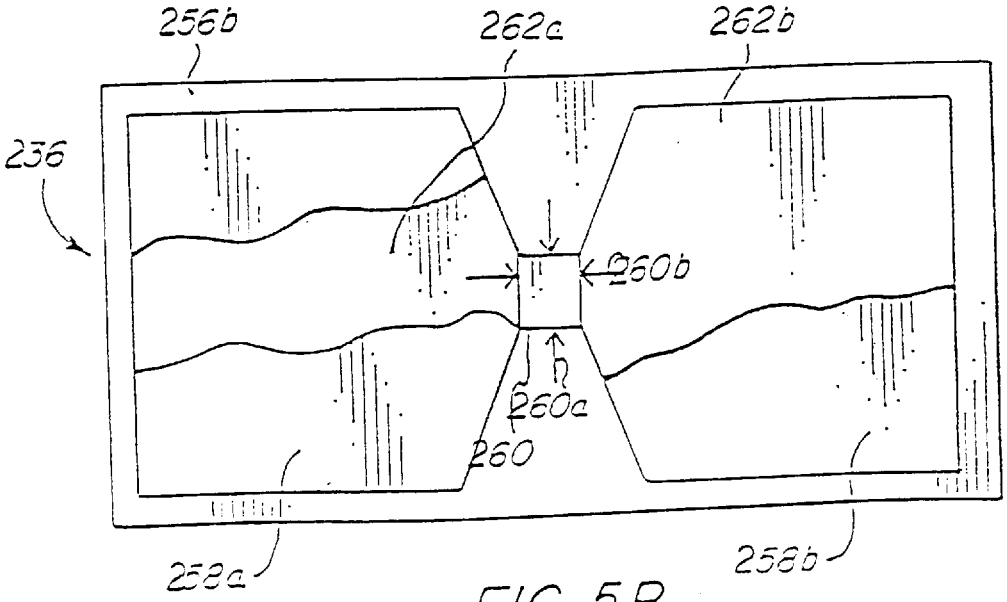
FIG. 5B is a view of the SCB initiator element of FIG. 5A taken along line 5B—5B.

Referring now to FIGS. 5A and 5B, SCB initiator element 236 is seen to comprise a non-electrically conducting substrate 256 that may comprise a silicon base 256*a* with a layer of silicon dioxide 256*b*. (Sapphire is known in the art for use as a substrate, and other materials such as alumina might be used as well. Silicon is preferred because of its favorable thermal properties.) On silicon dioxide layer 256*b* is a 2-micron thick layer of semiconductor material 258 which may comprise a phosphorus-doped polysilicon semiconductor layer in an hourglass configuration having two spaced apart pads 258*a*, 258*b* (FIG. 5B) joined by a thin-film bridge 260. Bridge 260 has a width 260*a*, a length 260*b* and a thickness equal to the thickness of layer 258. A typical thickness for semiconductor layer 258 is two microns. The level of doping in layer 258, which determines the resistivity of the semiconductor material, is coordinated with the planned length 260*b* (FIG. 5B) and width 260*a* and thickness of the semiconductor bridge 260 that will extend between the metallized lands to provide the desired resistance between them.

SCB initiator element 236 may be manufactured by well-known procedures involving photolithographic masking, chemical vapor deposition, etc., to precisely control the thickness, configuration and doping concentration of each layer of material, yielding highly consistent performance for large numbers of SCBs.

In the manufacture of initiator 210 (FIG. 3), base charge 214 is pressed into the empty housing 212. The ignition charge 218 is loosely disposed within housing 212 on top of base charge 214, but is not compacted therein. Separately, input leads 226*a* and 226*b* are secured in bushing 228 and initiator module 234, which is manufactured as described above, is secured onto bushing 228 by inserting connector studs 238*a* and 238*b* into coupling recesses 246*a*, 248*a*, to form the initiator assembly. Then, the initiator assembly is inserted into the housing to a depth at which SCB initiator element 236 contacts base charge 214 with a minimum of compressive force. Typically, a maximum pressure of approximately 1,000 psi is applied to the initiator assembly. When the initiator assembly is in place, crimp 230 is formed in housing 212 to retain bushing 228 in place.

When a low-energy electrical initiation signal is received from leads 226*a* and 226*b*, bridge 260 (FIG. 5B) vaporizes, initiating ignition charge 218, which in turn initiates base charge 214, which penetrates shell 212 to emit a pyrotechnical signal.

While the invention has been described in detail with reference to particular embodiments thereof, it will be apparent that upon a reading and understanding of the foregoing, numerous alterations to the described embodiments will occur to those skilled in the art and it is intended to include such alterations within the scope of the appended claims. For example, while the illustrated embodiments all show detonators whose initiation means comprise delay elements, the invention encompasses so-called "instantaneous" detonators, which lack any significant delay element. Also, the initiation means may be entirely electronic instead of relying on a non-electric signal transmission line, if desired.

What is claimed is:

1. A detonator comprising:

a housing;

a low-energy electronic initiation means in the housing;

an ignition charge disposed in the housing in direct initiation relation to the initiation means, the ignition charge comprising BNCP in pulverulent form comprising particles having an average size less than 10 $\mu$m and having a density of less than 65.9 percent of its theoretical maximum density (TMD), for producing a deflagration signal in the housing in response to a low-energy initiation signal from the initiation means; and an output charge in the housing for producing a detonation output signal in response to the deflagration signal of the ignition charge.

2. The detonator of claim 1 wherein the ignition charge has a density in the range of from about 49 to 65 percent of the TMD of the ignition charge.

3. The detonator of claim 2 wherein the ignition charge has a density in the range of from about 49 to about 59 percent of the TMD of the, ignition charge.

4. A detonator comprising:

a housing;

a low-energy electronic initiation means in the housing;

an ignition charge disposed in the housing in direct initiation relation to the initiation means, the ignition charge being in pulverulent form and having a density of less than 65.9 percent of its theoretical maximum density (TMD), for producing a deflagration signal in the housing in response to a low-energy initiation signal from the initiation means; and an output charge in the housing for producing a detonation output signal in response to the deflagration signal of the ignition charge wherein the ignition charge comprises an adherent bead disposed on the SCB.

5. The detonator of claim 4 wherein the bead comprises a mixture of BNCP and a binder.

6. The detonator of claim 1 comprising a containment shell secured to the initiation means in the housing, wherein the ignition charge is disposed within the containment shell.

7. A pyrotechnical output initiator comprising:

a housing;

a low-energy electronic initiation means in the housing;

an ignition charge disposed in the housing in direct initiation relation to the initiation means and comprising a charge of BNCP compacted to less than 7000 psi, for producing a deflagration signal in the housing in response to a low-energy initiation signal from the initiation means, the ignition charge comprising particles having an average particle size of less than 10 $\mu$m; and a pyrotechnical output charge in the housing for producing a pyrotechnical output signal in response to the deflagration signal of the ignition charge.

8. The initiator of claim 7 wherein the ignition charge is disposed in a pulverulent form and is subjected to a compaction force of less than 5880 psi.

9. The initiator of claim 8 wherein the ignition charge is subjected to a compaction force of less than 3000 psi.

10. The initiator of claim 9 wherein the ignition charge is subjected to a compaction force of less than 2000 psi.

11. A pyrotechnical output initiator comprising:

a housing;

an initiation means for producing an initiation signal that releases less than about 850 microJoules into the housing;

a BNCP ignition charge disposed in the housing in direct initiation relation to the initiation means, for producing a deflagration signal in the housing in response to a low-energy initiation signal from the initiation means; and a pyrotechnical output charge in the housing for producing a pyrotechnical output signal in response to the deflagration signal of the ignition charge.

12. The initiator of claim 11 comprising initiation means for releasing less than about 425 microJoules into the housing.

13. The initiator of claim 12 comprising initiation means for releasing less than about 250 microJoules into the housing.

14. The initiator of claim 13 comprising initiation means for releasing less than about 100 microJoules into the housing.

15. The initiator of claim 11, claim 12, claim 13 or claim 14 wherein the initiation charge comprises BNCP particles having an average size of less than 10 $\mu$m .

16. The initiator of claim 15 wherein the ignition charge comprises particles having an average particle size of less than 5 $\mu$m.

17. The initiator of claim 16 wherein the ignition charge comprises particles having an average diameter in the range of from about 0.5 $\mu$m to 2 $\mu$m.

18. The initiator of claim 11, claim 12, claim 13 or claim 14 wherein the initiation means comprises a semiconductor bridge (SCB) initiation element.

19. A pyrotechnical output initiator device comprising:

a housing;

a low-energy electronic initiation means in the housing;

an ignition charge disposed in the housing in direct initiation relation to the initiation means and comprising pulverulent BNCP having a density of less than 65.9 percent of its theoretical maximum density (TMD) for producing a deflagration signal in the housing in response to a low-energy initiation signal from the initiation means; and a pyrotechnical output charge in the housing for producing a pyrotechnical output signal in response to the deflagration signal of the ignition charge.

20. The initiator of claim 19 wherein the ignition charge has a density in the range of from about 49 to 65 percent of the TMD of the ignition charge.

21. The initiator of claim 20 wherein the ignition charge has a density in the range of from about 49 to about 59 percent of the TMD of the ignition charge.

22. The initiator of claim 19, claim 20 or claim 21 wherein the ignition charge comprises particles having an average size of less than 10 $\mu$m.

23. The initiator of claim 7, claim 9, claim 11 or claim 19 wherein the ignition charge comprises an adherent bead disposed on the initiation means.

24. The initiator of claim 23 wherein the bead comprises a mixture of BNCP and a binder.

25. The initiator of claim 7, claim 9, claim 11 or claim 19 comprising a containment shell secured to the initiation means in the housing, wherein the ignition charge is disposed within the containment shell.

26. A method of assembling a pyrotechnical output initiator, comprising:

pressing a pyrotechnical output charge into a detonator housing;

disposing a pulverulent BNCP ignition charge into the housing in signal transfer relation to the output charge;

securing an electronic initiation means in the detonator housing in initiation relation with the ignition charge; and compacting the ignition charge with a force of less than about 5880 psi.

27. A method for assembling an initiator, comprising:

pressing a pyrotechnical output charge into a housing;

pressing an electronic initiation means into a BNCP ignition charge with a force of less than about 5880 psi;

securing the ignition charge to the initiation means; and securing the ignition charge in the housing in signal transfer relation with the output charge without further compacting the ignition charge.

28. The method of claim 26 or claim 27 comprising compacting the ignition charge with a force of less than about 3000 psi.

29. The method of claim 28 comprising compacting the ignition charge with a force of less than about 2000 psi.

30. The detonator of any one of claims 1, 2, 3, 4, 5 and 6 wherein the low-energy electronic initiation means comprises a semiconductor bridge initiator (SCB).

31. The detonator of claim 30 wherein the SCB is configured to consume less than about 850 millijoules to generate a plasma.

32. The initiator of any one of claims 7, 8, 9, 10, 11 or 19 wherein the low-energy electronic initiation means comprises a semiconductor bridge initiator (SCB).

33. The initiator of claim 32 wherein the SCB is configured to consume less than about 850 millijoules to generate a plasma.

34. A method of assembling a pyrotechnical output initiator, comprising:

pressing a pyrotechnical output charge into a detonator housing;

disposing a pulverulent BNCP ignition charge into the housing in signal transfer relation to the output charge;

securing a semiconductor bridge initiator (SCB) in the detonator housing in initiation relation with the ignition charge; and compacting the ignition charge with a force of less than about 5880 psi.

35. The method of claim 34 wherein the SCB is configured to consume less than about 850 milliJoules to generate a plasma.

36. A method for assembling an initiator, comprising:

pressing a pyrotechnical output charge into a housing;

pressing a semiconductor bridge initiator (SCB) into a BNCP ignition charge with a force of less than about 5880 psi;

securing the ignition charge to the semiconductor bridge initiator; and securing the ignition charge in the housing in signal transfer relation with the output charge without further compacting the ignition charge.

37. The method of claim 36 wherein the SCB is configured to consume less than about 850 milliJoules to generate a plasma.

38. The method of claim 34, claim 35, claim 36 or claim 37 comprising compacting the ignition charge with a force of less than about 3000 psi.

39. The method of claim 38 comprising compacting the ignition charge with a force of less than about 2000 psi.

* * * * *

UNITED STATES PATENT AND TRADEMARK OFFICE

CERTIFICATE OF CORRECTION

PATENT NO. : 6,408,759 B1
DATED : June 25, 2002
INVENTOR(S) : Ewick et al.

It is certified that error appears in the above-identified patent and that said Letters Patent is hereby corrected as shown below:

Column 2,
Line 21, replace “iriter” with -- igniter --;

Column 3,
Line 32, replace “farther” with -- further --;

Column 9,
Line 47, replace “et at” with -- et al --;

Column 11,
Line 54, replace “elation” with -- relation --;
Line 55, replace “DT” with -- DDT --.

Signed and Sealed this

Eighteenth Day of November, 2003

JAMES E. ROGAN
*Director of the United States Patent and Trademark Office*